US006540583B1

(12) United States Patent
Hoeting et al.

(10) Patent No.: US 6,540,583 B1
(45) Date of Patent: Apr. 1, 2003

(54) TOY VEHICLE

(76) Inventors: Michael G. Hoeting, BANGZOOM design, Ltd., 2150 Alpine Pl., Cincinnati, OH (US) 45206; Sean T. Mullaney, BANGZOOM design, Ltd., 2150 Alpine Pl., Cincinnati, OH (US) 45206

( * ) Notice: Subject to any disclaimer, the term of this patent is extended or adjusted under 35 U.S.C. 154(b) by 0 days.

(21) Appl. No.: 10/037,781

(22) Filed: Oct. 19, 2001

(51) Int. Cl.[7] ..... A63H 17/00

(52) U.S. Cl. ..... 446/431; 446/456; 446/443; 446/437

(58) Field of Search ..... 446/441, 443, 446/437, 456, 466, 460, 454, 455, 462, 468, 431; 180/6.48, 6.5, 209

(56) References Cited

U.S. PATENT DOCUMENTS

| | | | | |
|---|---|---|---|---|
| 2,587,052 A | | 2/1952 | Lohr | |
| 3,813,812 A | | 6/1974 | Barlow et al. | |
| 3,871,129 A | | 3/1975 | Tong | |
| 4,187,637 A | | 2/1980 | Nielsen | |
| 4,438,589 A | | 3/1984 | Matsushiro | |
| 4,457,101 A | | 7/1984 | Matsushiro | |
| 4,596,534 A | | 6/1986 | Ishimoto | |
| 4,666,420 A | | 5/1987 | Nagano | |
| 4,680,021 A | | 7/1987 | Maxim | |
| 4,822,316 A | | 4/1989 | Shaffer et al. | |
| 4,846,758 A | | 7/1989 | Chou | |
| 4,892,503 A | | 1/1990 | Kumazawa | |
| 4,902,271 A | | 2/1990 | Yoneda | |
| 5,019,009 A | | 5/1991 | Chao-Chin | |
| 5,228,880 A | | 7/1993 | Meyer et al. | |
| 5,259,808 A | | 11/1993 | Garr | |
| 5,667,420 A | | 9/1997 | Menow et al. | |
| 5,667,421 A | | 9/1997 | Uetake | |
| 5,762,533 A | | 6/1998 | Tilbor et al. | |
| 5,803,790 A | | 9/1998 | Tilbor et al. | |
| 6,024,627 A | * | 2/2000 | Tilbor et al. | 446/456 |
| 6,234,866 B1 | | 5/2001 | Ben-Yakar et al. | |
| 6,394,876 B1 | * | 5/2002 | Ishimoto | 446/428 |

* cited by examiner

*Primary Examiner*—Derris H. Banks
*Assistant Examiner*—Jamila Williams
(74) *Attorney, Agent, or Firm*—Wood, Herron & Evans, L.L.P.

(57) ABSTRACT

A toy vehicle includes a chassis having front and rear portions with a wheel supporting the front portion of the chassis. The toy vehicle further includes spaced-apart swing arms connected to the rear portion of the chassis. Rear wheels are rotatably mounted to each end of the swing arms. The swing arms are independently movable with respect to the chassis between first and second positions. Two separate propulsion drives are operatively associated with the chassis and are drivingly coupled to respective rear wheels. Each propulsion drive is adapted to independently drive the respective rear wheels in either a first direction or a second opposite direction.

16 Claims, 7 Drawing Sheets

TOY VEHICLE

FIELD OF THE INVENTION

The present invention relates to a remote control toy vehicle, and more particularly, a remote control toy vehicle with independently controlled drive wheels.

BACKGROUND

Many remotely controlled toy vehicles attempt to duplicate well known vehicles, such as cars, trucks, motorcycles, racing vehicles, tanks, aircraft, space vehicles, and construction vehicles. With these so-called "real life" vehicles, the goal is to imitate the functional characteristics, such as the movement, of the actual life-sized vehicle, but on a reduced scale vehicle. While these types of vehicles can entertain the user by imitating a real life vehicle, the range of motion of most "real life" vehicles is somewhat limited and the movement of these vehicles follow a known behavior. Thus, the user may also desire a toy vehicle which does not behave like a known real life vehicle. That is, the user may be entertained by a vehicle that has a wide range of motion and moves in unusual and unexpected ways.

Thus, it is believed that a toy vehicle that has a wide range of motion and could move in unusual and unexpected ways would be desired.

SUMMARY OF THE INVENTION

The toy vehicle of the present invention has a wide range of motion and can move in unusual and unexpected ways. To that end and in accordance with the principles of the invention, the toy vehicle includes a chassis having front and rear portions with at least one wheel supporting the front portion of the chassis. The toy vehicle further includes spaced-apart swing arms connected to the rear portion of the chassis. Rear wheels are rotatably mounted to each end of the swing arms. The swing arms are independently movable with respect to the chassis between first and second positions. As a given swing arm moves between the first position to the second position, the rear wheel is moved forward with respect to the chassis. Two separate propulsion drives are operatively associated with the chassis and are drivingly coupled to the respective rear wheels. Each propulsion drive is adapted to independently drive, or spin, a respective rear wheel in either a first direction or a second opposite direction. A rear wheel spinning in the first direction tends to move the toy vehicle forward whereas a rear wheel spinning in the second direction tends to move the toy vehicle rearward. In one aspect of the invention, the toy vehicle may be remotely controlled by an operator with a radio transmitter transmitting appropriate radio frequency signals. Thus, to be remotely controlled, the toy vehicle would include a receiver adapted to receive the remotely generated radio frequency signals. The receiver would be operatively connected to each drive motor independently such that each drive motor could be operated independently of the other. Accordingly, an operator could, for example, drive one rear wheel in the first or forward direction while simultaneously driving the other rear wheel in the second or rearward direction.

In one aspect of the invention, the toy vehicle further includes an anti-tipping structure or wheelie bar affixed to at least one of the swing arms to prevent the toy vehicle from tipping backwards when both swing arms are in the second position. In the alternative, the wheelie bar could be affixed to the rear portion of the chassis to prevent the toy vehicle from tipping backwards.

In another aspect of the invention, the toy vehicle includes a self-righting member that extends from the chassis. The self-righting member is configured to enable at least one of the rear wheels to contact the support surface when the toy vehicle has flipped over to a non-upright position.

In another embodiment of the invention, the toy vehicle includes a wheeled steering mechanism supporting the front portion of the chassis. The wheeled steering mechanism includes an elongated member having a slot extending therethrough. The elongated member is pivotally connected to the front portion of the chassis. An axle extends through and is slidably movable within the slot. The axle has a wheel disposed at each of its opposite ends. As the toy vehicle moves in a forward direction, the axle slides rearwardly in the slot of the elongated member such that it is disposed rearwardly of the pivot connection of the elongated member. As such, the wheeled steering mechanism provides a castering effect when the toy vehicle is moving in a forward direction. The same castering effect is achieved when the toy vehicle moves rearward causing the axle to slide to a position forward of the pivot connection of the elongated member.

Other aspects and advantages of the invention will become apparent from the following Detailed Description and the accompanying drawings.

DETAILED DESCRIPTION OF THE PREFERRED EMBODIMENTS

Figure 1:
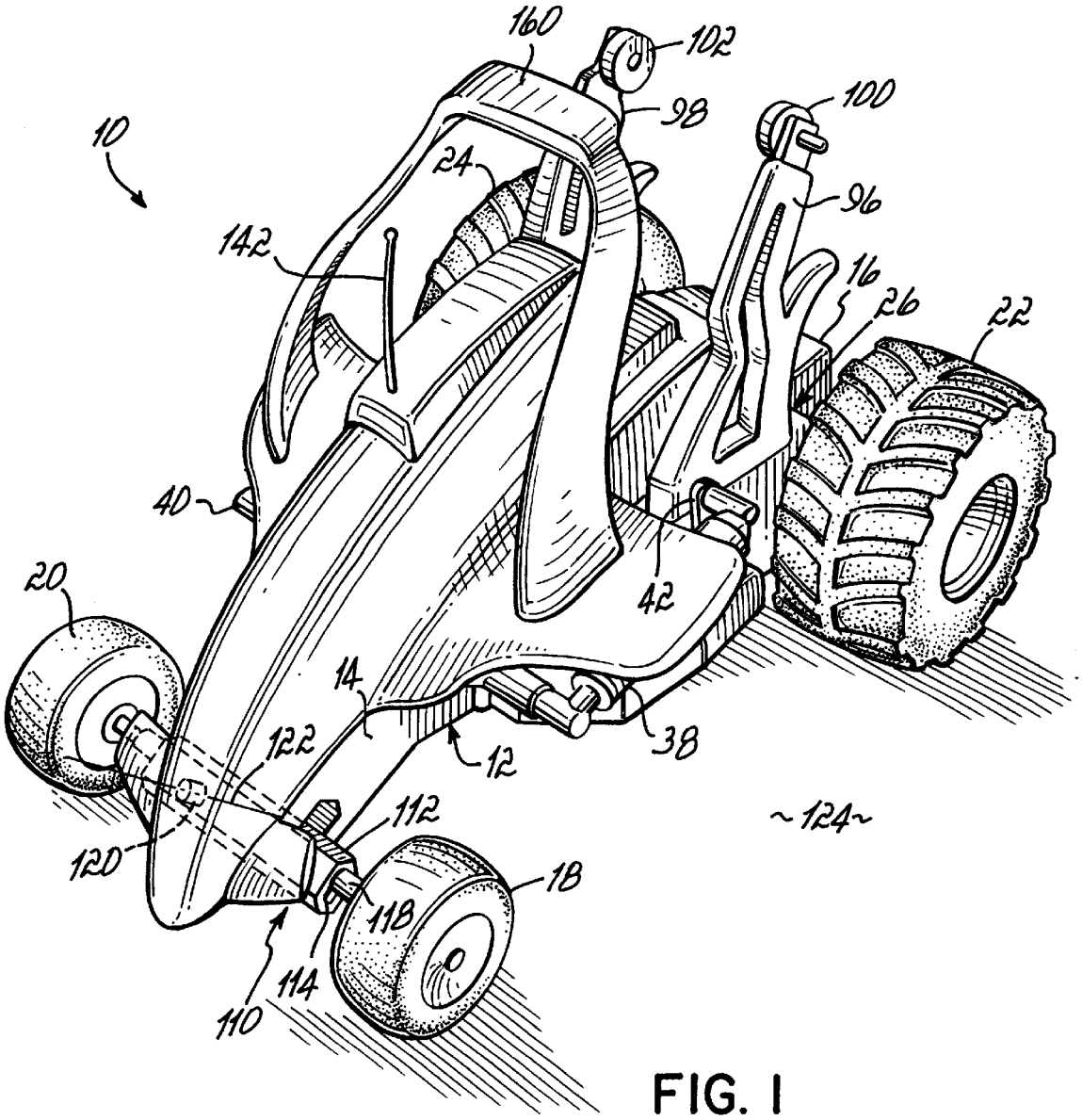
FIG. 1 is a perspective view of a toy vehicle in accordance with a preferred embodiment of the present invention.
Figure 2:
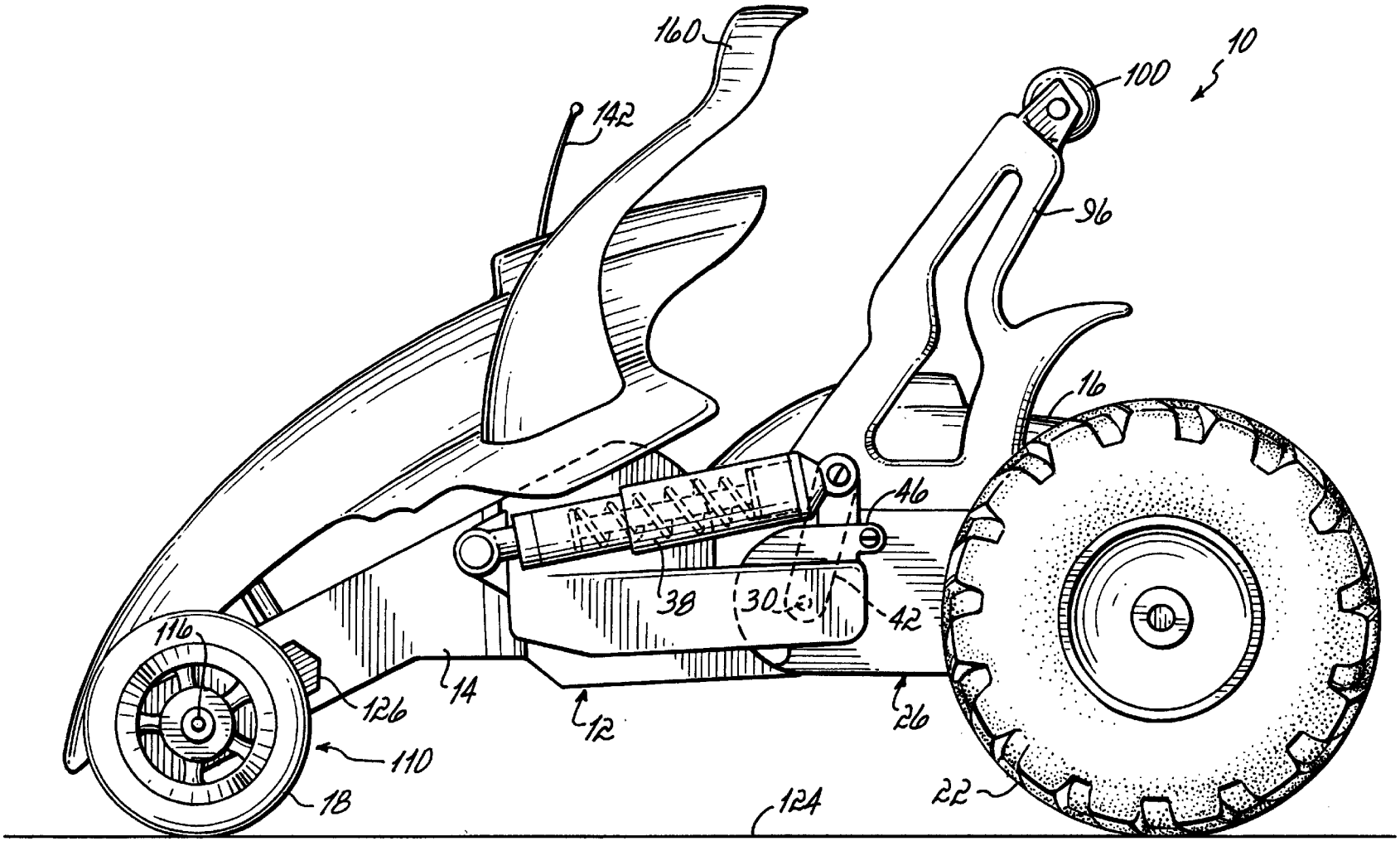
FIG. 2 is a side view of the toy motorcycle shown in FIG. 1.
Figure 3:
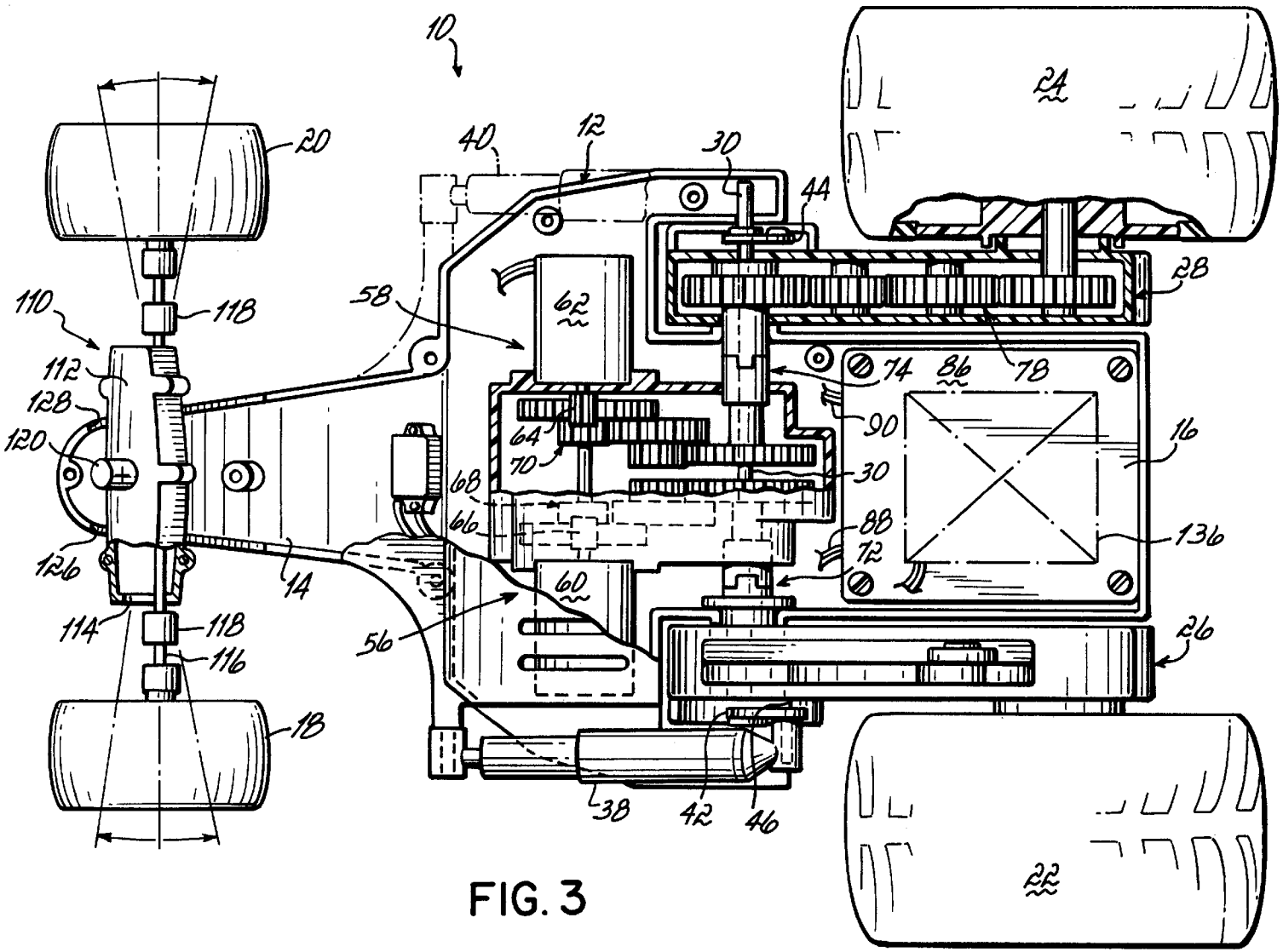
FIG. 3 is a top plan view, partially cut-away, of the toy vehicle shown in FIG. 1.
Figure 4:
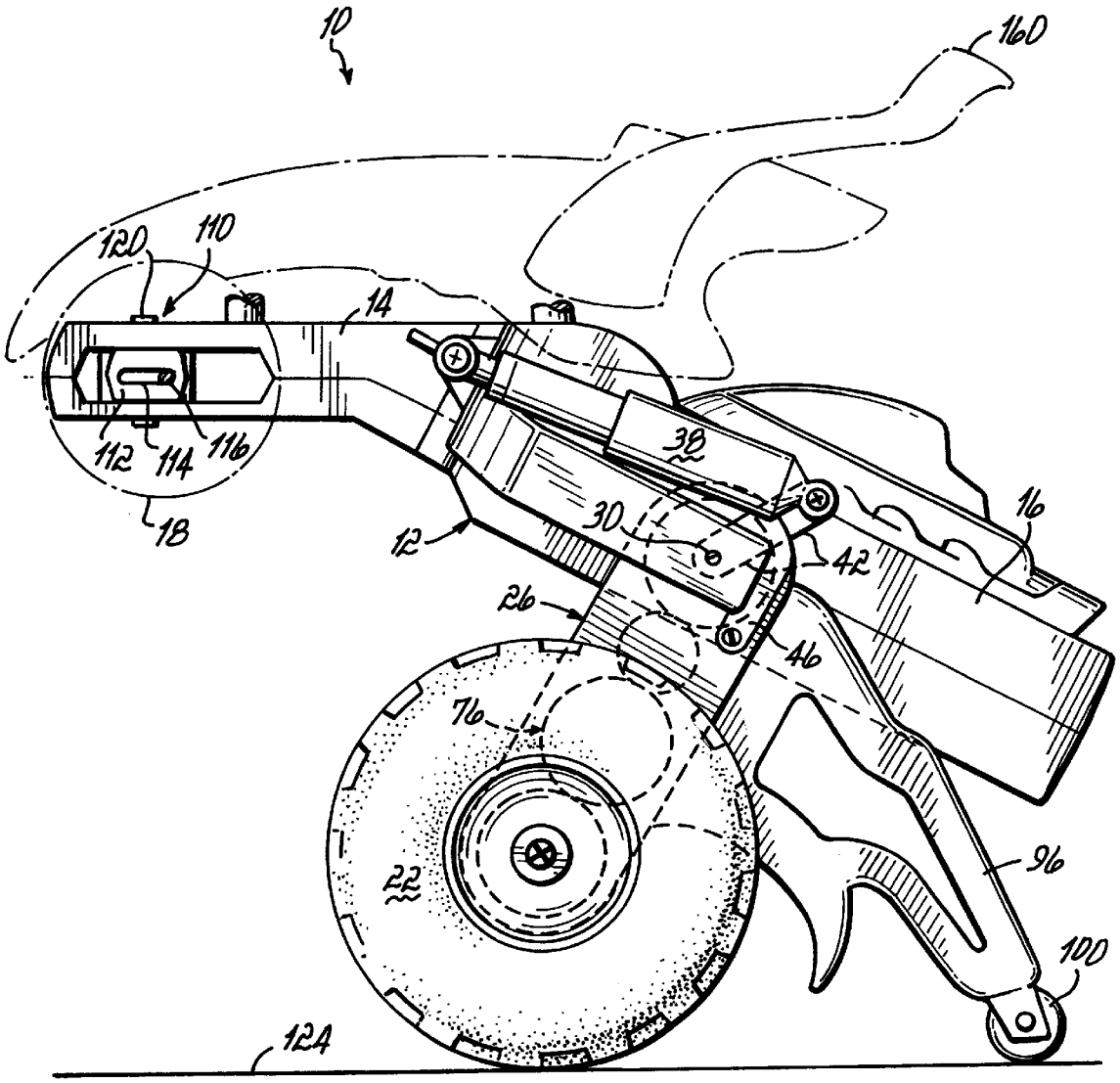
FIG. 4 is another side view of the toy motorcycle shown in FIG. 1 being supported by the rear wheels and the wheelie bars.

With reference to FIGS. 1–3, a toy vehicle 10 constructed according to a preferred embodiment of the present invention is illustrated. The toy vehicle 10 includes a chassis 12 having front and rear portions 14, 16 supported respectively by front wheels 18, 20 and by rear wheels 22, 24. Pivotally connected to the rear portion 16 of chassis 12 are spaced apart swing arms 26, 28 to which rear wheels 22, 24 are rotatably mounted. Swing arms 26, 28 pivot about a stationary axle 30 which extends transversely across substantially the entire width of the chassis 12. As will be discussed in greater detail below, swing arms 26, 28 are free to pivot independently of one another between, for example, a first position as shown in FIG. 2 and a second position as shown in FIG. 4. With swing arms 26, 28 in the second position, rear wheels 22, 24 are closer to front portion 14 of chassis 12 compared to rear wheels 22, 24 when the swing arms 26, 28 are in the first position. Bias members, such as shock absorbers, 38, 40 extend between the front portion 14 of chassis 12 and links 42, 44 which are pivotally connected about axle 30. Links 42, 44 can pivot about axle 30 independently of swing arms 26, 28. However, swing arms 26, 28 including stop members 46 (FIG. 4) proximate to where the swing arms 26, 28 pivot about axle 30 that engage links 42, 44 to maintain swing arms 26, 28 in their first position. Stop members 46 disengage links 42, 44 as swing arms 26, 28 pivot from the first position toward the second position.

Figure 9:
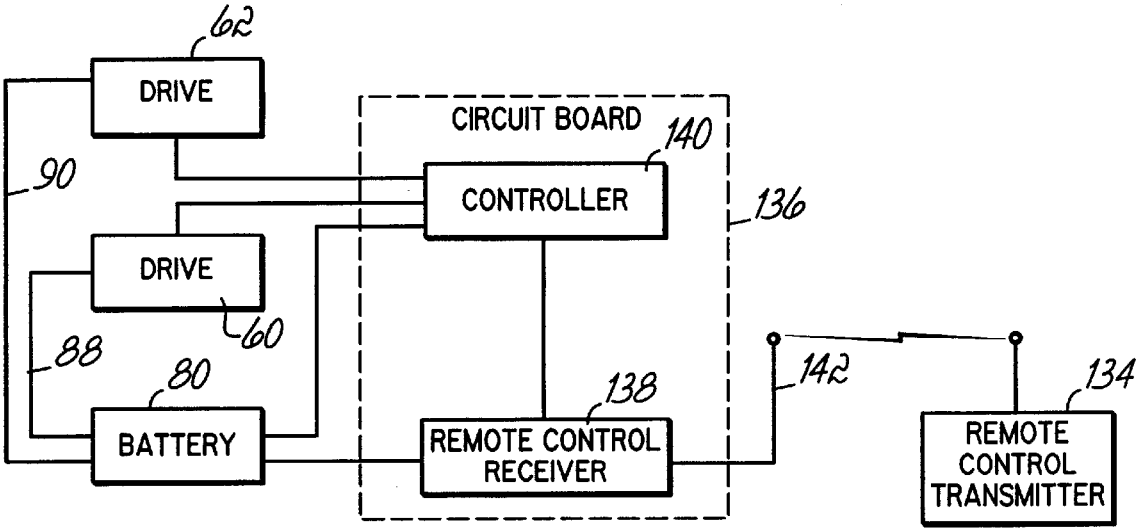
FIG. 9 is a schematic view of the electrical controls for the toy vehicle of FIG. 1.

With specific reference to FIG. 3, the toy vehicle 10 includes two independent propulsion drives 56, 58 that include drive motors 60, 62. Each drive motor 60, 62 has drive gears 64, 66 which drivingly engaged a respective plurality of intermeshing gears 68, 70. Couplers 72, 74 couple intermeshing gears 68, 70 to a second plurality of intermeshing gears 76, 78 (FIG. 4) which drive rear wheels 22, 24. Although intermeshing gears 68, 70, 76, 78 ultimately connect drive motors 60, 62 to rear wheels 22, 24, other suitable mechanisms, such as belts or chains, may also be used to connect drive motors 60, 62 to the rear wheels 22, 24. A power supply such as a battery 80 (FIG. 9) is located beneath protective cover 86 in the rear portion 16 of chassis 12 powers drive motors 60, 62 via electrical wires 88, 90. Advantageously, battery 80 is removable from chassis 12 so that it may be recharged.

Drive motors 60, 62 operate independently of one another. That is, drive motor 60 drives or rotates rear wheel 22 regardless of whether drive motor 62 drives rear wheel 24. Moreover, each drive motor 60, 62 can operate in either a forward direction or a rearward direction. In other words, drive motor 60 can either spin or rotate rear wheel 22 in a direction tending to move the toy vehicle 10 in a forward direction or in a direction tending to move the toy vehicle 10 in an opposite rearward direction. Because drive motors 60, 62 can be driven independently of each other, drive motor 60 may be driven in the forward direction while simultaneously drive motor 62 may be driven in the opposite reverse direction.

Anti-tipping structures or wheelie bars 96, 98 are affixed to respective upper portions of swing arms 26, 28 to prevent the toy vehicle 10 from tipping too far backwards when both swing arms 26, 28 are pivoted to the second position as shown in FIG. 4. Moreover, rollers 100, 102 are located at the distal ends of the wheelie bars 96, 98 so that the toy vehicle 10 can move in a forward direction supported by and rolling on both rollers 100, 102 and rear wheels 22, 24. It will be appreciated that wheelie bars 96, 98 or modified versions thereof could also be attached to the rear portion 16 of chassis 12 instead of to swing arms 26, 28 to prevent the toy vehicle 10 from tipping backwards with swing arms 26, 28 in the second position.

Figure 7:
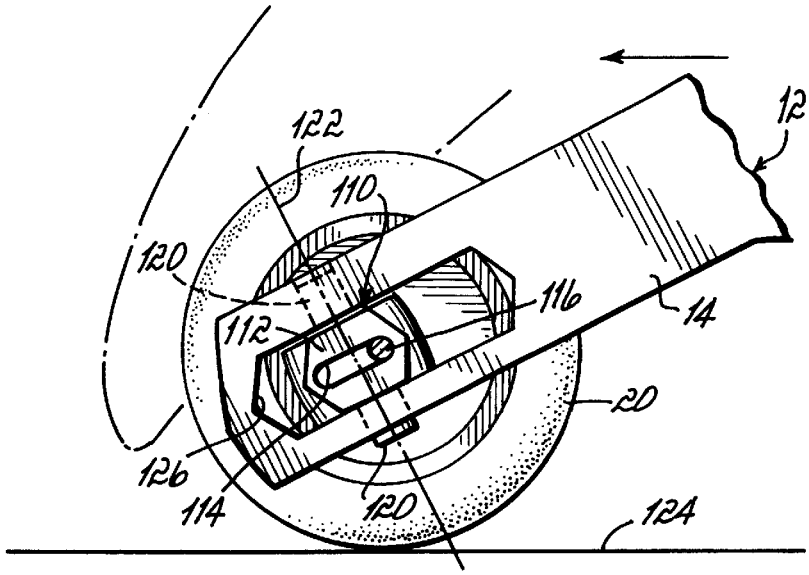
FIG. 7 is an enlarged elevation view in partial cross section of the front steering mechanism of the toy vehicle of FIG. 1.
Figure 6:
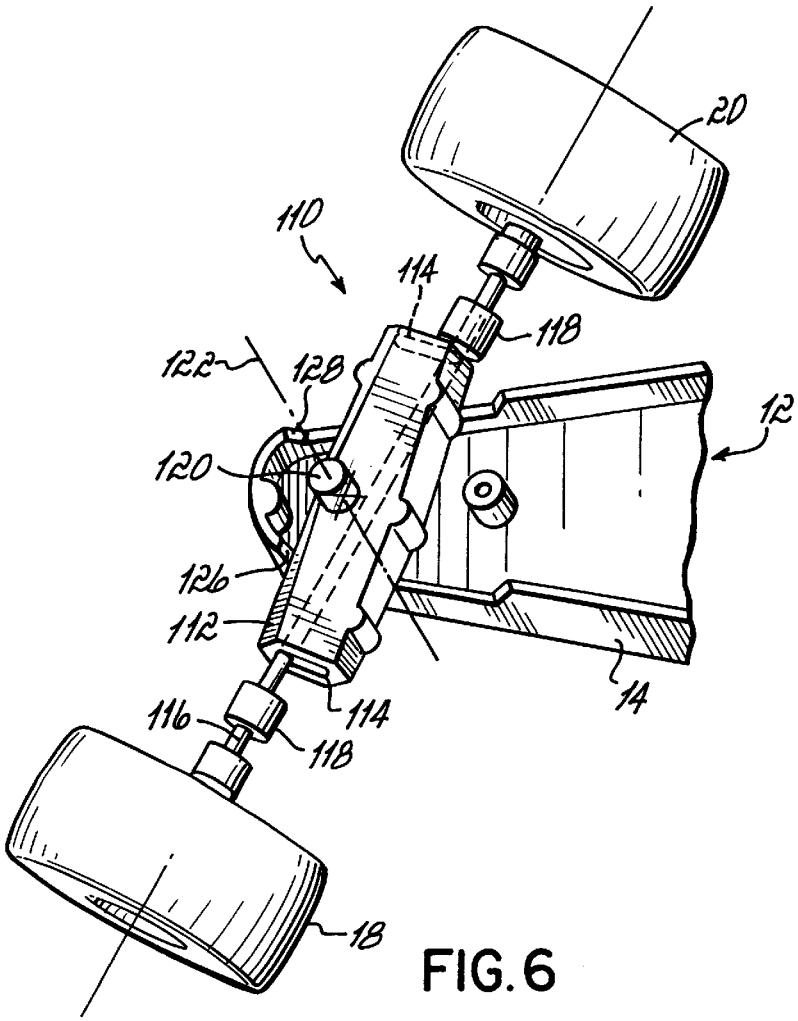
FIG. 6 is an enlarged partial perspective view of the front steering mechanism of the toy vehicle of FIG. 1 as viewed from the top.

With reference to FIGS. 3, 6, and 7, the toy vehicle 10 includes a steering mechanism 110 that includes an elongated member 112 having a slot 114 extending therethrough. The steering mechanism further includes an axle 116 that extends through the slot 114. Front wheels 18, 20 are rotatably mounted on opposite ends of axle 116. Axle 116 is free to move within slot 114. That is, axle 116 is free to translate both forwards and backwards along slot 114 as well as pivot in slot 114 as illustrated in FIG. 6, for example. Stop members 118 may be affixed to opposite sides of the axle 116 between the opposite ends of the slot 114 and the front wheels 18, 20. Although axle 116 is free to move within slot 114, stop members 118 limit the lateral movement of the axle 116 relative to the slot 114.

Elongated member 112 is pivotally mounted to the front portion 14 of chassis 12 at pivot member 120 which extends from elongated member 112. More specifically, elongated member 112 pivots about axis 122 which is tilted forward relative to a line perpendicular to support surface 124 upon which the toy vehicle 10 travels as best illustrated in FIG. 7. Axle 116 move forwards and backwards in slot 114 along a plane which is substantially perpendicular to axis 122. As the toy vehicle 10 moves forward, the axle 116 slides to the rear portion of the slot 114 and is positioned rearward of axis 122. As such, the steering mechanism 110 casters about axis 122 such that the toy vehicle 10 tends to move in a straight line even if the front wheels 18, 20 encounter a disturbance which would otherwise upset the straight line track of the toy vehicle 10. When the toy vehicle 10 moves rearward, the axle 116 slides to the front portion of the slot 114 and is positioned forward of axis 122. Accordingly, like the castering effect achieved when the toy vehicle 10 moves forward, steering mechanism 110 casters about axis 122 as the toy vehicle 10 moves rearward.

The pivotal movement of elongated member 112 about pivot member 120 is restricted by sidewall portions 126, 128 which form part of front portion 14 of chassis 12. As illustrated in FIG. 6, axle 116 can pivot slightly further than elongated member 112 because axle 116 can pivot within slot 114.

In operation, an operator remotely controls the toy vehicle 10 with a remote control transmitter 134 (FIG. 9) which selectively transmits control signals. Advantageously, the remote control transmitter 134 transmits control signals over two independent channel so that the drive motors 60, 62 may be controlled independently of one another. The toy vehicle 10 includes an electronic circuit board 136 position directly over protective cover 86 that includes a remote control receiver 138 and a controller 140. The receiver 138 is operative connected to the battery 80 and controller 140. The controller 140 is operative connected to battery 80 and drive motors 60, 62. The toy vehicle further includes an antenna 142 which receives the control signals from the remote control transmitter 134 and relays those signals to the remote control receiver 138.

The remote control receiver 138 receives control signals from the remote control transmitter 134 as the operator directs the toy vehicle 10 to move is a particular direction. With a two channel remote transmitter 134, the operator can independently control the operation of each drive motor 60, 62 independently of the other. In other words, the operator can remotely operate both drive motors 60, 62 in a forward direction, in a rearward direction, or alternatively, one drive motor in a forward direction and the other drive motor in a rearward direction or not at all. Thus, the direction the toy vehicle 10 travels depends on which direction the drive motors 60, 62 are operated. If, for example, both drive motors 60, 62 are operated a forward direction, the toy vehicle 10 will move forward in a straight line.

Figure 5:
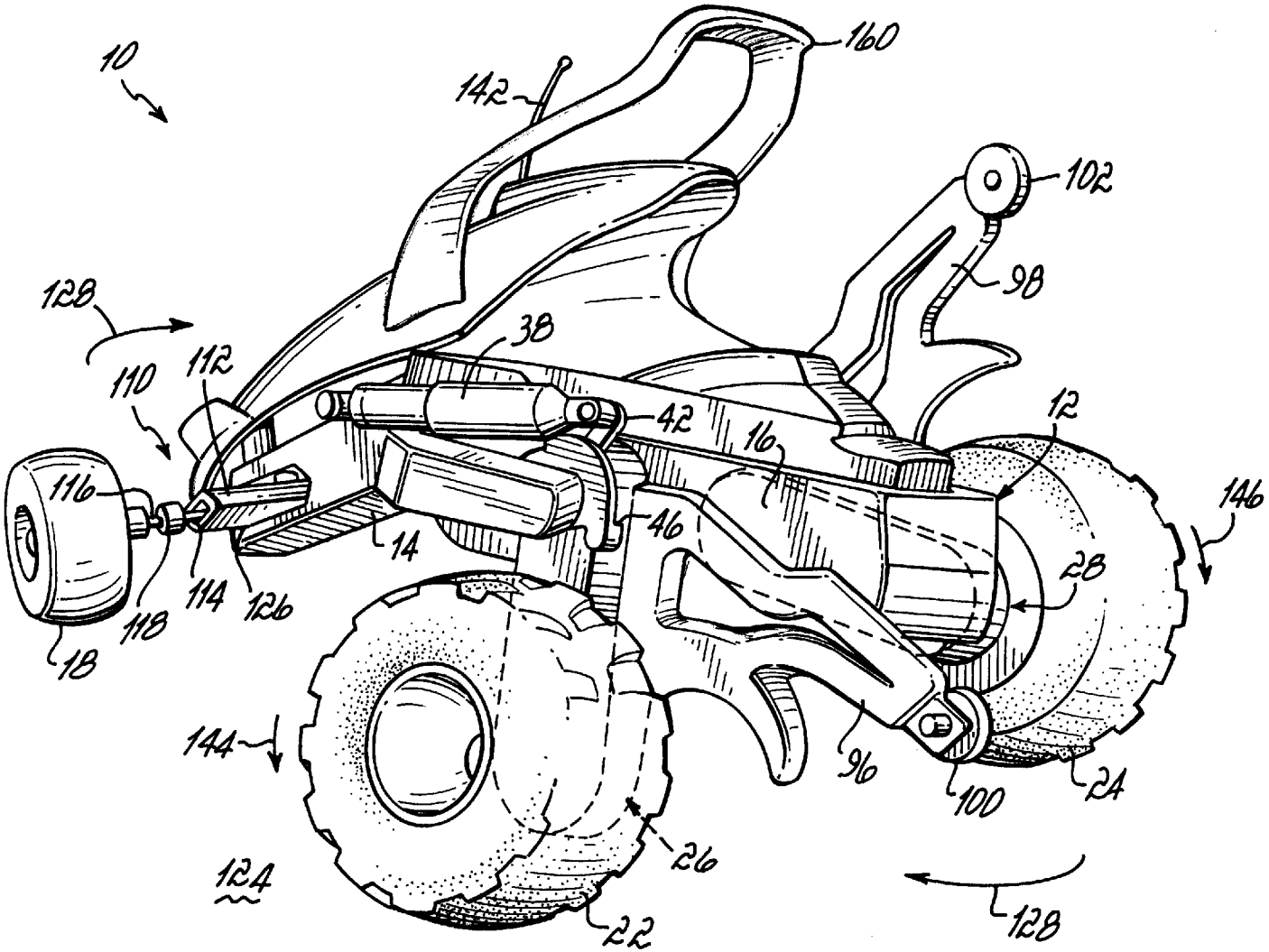
FIG. 5 is a perspective view of the toy vehicle shown in FIG. 1 with the left swing arm pivoted downwardly relative to the chassis.

The toy vehicle, however, will turn sharply should only one drive motor be operated and even more sharply should one drive motor be operated in a forward direction and the other drive motor be operated in a rearward direction. When one drive motor 60, 62 is operated alone in the forward direction, the associated swing arm 26, 28 pivots from the first position illustrated in FIG. 2 to the second position illustrated in FIG. 5. By way of example and as illustrated in FIG. 5, drive motor 60 is operating to spin rear wheel 22 in a forward direction as shown by arrow 144 such that swing arm 26 is pivoted from the first position to the second position. As swing arm 26 pivots to and remains in the second position, the steering mechanism 110 pivots clockwise as viewed looking down on the toy vehicle 10 until the steering mechanism 110 engages sidewall portion 126. In this configuration, the toy vehicle 10 spins in clockwise circle as indicated by arrows 128, with the circle having a first radius. Should drive motor 62 be operated to spin rear wheel 24 in the rearward direction as shown by arrow 146 with drive motor 60 operating in the forward direction, toy vehicle 10 will spin in a clockwise circle having a second radius smaller than the first radius.

Should both drive motors 60, 62 be operated in the rearward direction, the toy vehicle 10 will move rearwardly in a substantially straight line. If the operator were to command that both drive motors 60, 62 be switched instantly from the rearward direction to a forward direction, both swing arms 26, 28 would pivot from the first position to the second position as shown in FIG. 4. With both swing arms 26, 28 in the second position, rollers 100, 102 located at the respective ends of wheelie bars 96, 98 contact support surface 124. As such, the toy vehicle 10 will move forward while being supported by rear wheels 22, 24 and rollers 100, 102. In this configuration, should drive motor 62 then be shut off, swing arm 28 will return to its first position and the toy vehicle 10 will begin to spin clockwise as shown in FIG. 5.

Figure 8:
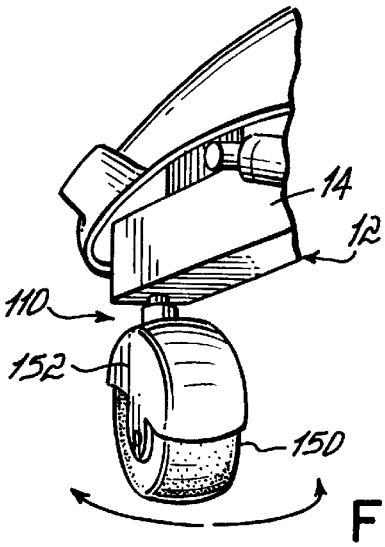
FIG. 8 is a perspective view of an alternate embodiment of the steering mechanism of the toy vehicle shown in FIG. 1 with a single castering front wheel.

The toy vehicle 10 described above is a four-wheeled vehicle. The toy vehicle 10, however, may operate as a three-wheeled vehicle. One such embodiment of a three-wheeled version of toy vehicle 10 is shown in FIG. 8. In this embodiment, steering mechanism 110 and front wheels 18, 20 are replaced by a single castering wheel 150 connected to front portion 14 of chassis 12 by support member 152. The steering characteristics of this embodiment are similar to those of the embodiment described above. That is, when swing arm 26 moves from the first position to the second position, castering wheel 150 will pivot such that the toy vehicle 10 will spin in a clockwise direction. When swing arm 26 returns to its first position, castering wheel 150 will pivot such that the toy vehicle 10 will continue along a straight path.

During normal operation, the toy vehicle 10 operates in an upright position as illustrated in FIGS. 2, 4, and 5. In this context, upright position means that, while toy vehicle 10 is operating, at least the two rear wheels 22, 24 remain in contact with the support surface 124 whether the toy vehicle is traveling straight, spinning, or up on rear wheels 22, 24 and rollers 100, 102. While operating, the toy vehicle 10 may encounter some obstacle, such as a wall, a door, or a chair leg, causing the toy vehicle 10 to flip over to a non-upright position, such that both rear wheels 22, 24 no longer contact support surface 40. To accommodate for those instances when the toy vehicle 10 flips over to a non-upright position, toy vehicle 10 includes a self-righting member or roll bar 160. Roll bar 160 is configured such that when toy vehicle 10 is in any non-upright position, the toy vehicle 10 will rest upon the roll bar 160 with at least one rear wheel 22, 24 contacting support surface 124. With one rear wheel 22, 24 in contact with the support surface 124, the operator can activate that particular rear wheel 22, 24 to start the toy vehicle 10 spinning. The spinning, non-upright toy vehicle 10 should flip back to the upright position after of couple of spins, allowing the toy vehicle 10 to operate normally without requiring the operator to physically touch the toy vehicle.

While the present invention has been illustrated by a description of various preferred embodiments and while these embodiments have been described in considerable detail in order to describe the best mode of practicing the invention, it is not the intention of the applicants to restrict or in any way limit the scope of the appended claims to such detail. Additional advantages and modifications within the spirit and scope of the invention will readily appear to those skilled in the art. The invention itself should only be defined by the appended claims, wherein.

We claim:

1. A toy vehicle comprising:

a chassis having front and rear portions;

at least one wheel supporting said front portion of said chassis;

first and second spaced-apart swing arms having first and second ends, said first end being connected to said rear portion of said chassis, each of said second ends having a rear wheel rotatably mounted thereto, each of said swing arms being independently movable with respect to said chassis between first and second positions, whereby said rear wheels move closer to said front portion when said swing arms are moved from said first position to said second position; and first and second propulsion drives operatively associated with said chassis and drivingly coupled to respective rear wheels, each propulsion drive adapted to independently drive a respective rear wheel in either a first direction or a second opposite direction.

2. The toy vehicle of claim 1, further comprising an anti-tipping structure affixed to at least one of said swing arms to prevent the toy vehicle from tipping backwards when both swing arms are in said second position.

3. The toy vehicle of claim 1, further comprising an anti-tipping structure affixed to said rear portion of said chassis to prevent the toy vehicle from tipping backwards when both swing arms are in said second position.

4. The toy vehicle of claim 1, further comprising a remote control receiver adapted to receive remotely generated control signals, said receiver operatively connected to each of said propulsion drives whereby said receiver may independently control each of said propulsion drives.

5. The toy vehicle of claim 1, further comprising a bias member extending between one of said swing arms and said chassis.

6. The toy vehicle of claim 1, wherein the toy vehicle operates on a support surface in an upright position and further comprises a self-righting member extending from said chassis, said self-righting member being configured to enable at least one of said rear wheels to contact the support surface when the toy vehicle is in a non-upright position.

7. The toy vehicle of claim 1, wherein said chassis has a longitudinal axis, said swing arms being substantially parallel to said longitudinal axis when in said first position and substantially perpendicular to said longitudinal axis when in said second position.

8. The toy vehicle of claim 1, further comprising a wheeled steering mechanism supporting said front portion of said chassis.

9. The toy vehicle of claim 8, wherein said wheeled steering mechanism comprises:

an elongated member having a slot extending therethrough, said elongated member being pivotally connected to said front portion of said chassis;

an axle extending through said slot, said axle having wheels disposed on opposite end of said axle, said axle being slidably movable within said slot.

10. A toy vehicle comprising:

a chassis having front and rear portions;

a wheeled steering mechanism supporting said front portion of said chassis;

first and second spaced-apart swing arms having first and second ends, said first end being connected to said rear portion of said chassis, each of said second ends having a rear wheel rotatably mounted thereto, each of said swing arms being independently movable with respect to said chassis; and first and second propulsion drives operatively associated with said chassis and drivingly coupled to respective rear wheels, each propulsion drive adapted to independently drive a respective rear wheel in either a first direction or a second opposite direction.

11. The toy vehicle of claim 10, wherein said wheeled steering mechanism comprises:

an elongated member having a slot extending therethrough, said elongated member being pivotally connected to the front portion of said chassis;

an axle extending through said slot, said axle having wheels disposed on opposite end of said axle, said axle being slidably movable within said slot.

12. The toy vehicle of claim 10, further comprising a remote control receiver adapted to receive remotely generated control signals, said receiver operatively connected to each of said propulsion drives whereby said receiver may independently control each of said propulsion drives.

13. The toy vehicle of claim 10, wherein the toy vehicle operates on a support surface in an upright position and further comprising a self-righting member extending from said chassis, said self-righting member being configured to enable at least one of said rear wheels to contact the support surface when the toy vehicle is in a non-upright position.

14. A toy vehicle comprising:

a chassis having front and rear portions;

a wheeled steering mechanism supporting said front portion of said chassis, said wheeled steering mechanism comprising:

an elongated member having a slot extending therethrough, said elongated member being pivotally connected to the front portion of said chassis; and an axle extending through said slot, said axle having wheels disposed on opposite end of said axle, said axle being slidably movable within said slot;

first and second rear wheels rotatably mounted to said rear portion of said chassis; and first and second propulsion drives operatively associated with said chassis and drivingly coupled to respective rear wheels, each propulsion drive adapted to independently drive a respective rear wheel in either a first direction or a second opposite direction.

15. The toy vehicle of claim 14, wherein said axle slides to a rearward position in said slot when both of said rear wheels are operated in a first direction so as to provide a castering effect for said steering mechanism, said axle slides to a forward position in said slot when both of said rear wheels are operated in a first direction so as to provide a castering effect for said steering mechanism.

16. A remotely controlled toy vehicle comprising:

a chassis having front and rear portions;

a wheeled steering mechanism supporting said front portion of said chassis, said wheeled steering mechanism comprising:

an elongated member having a slot extending therethrough, said elongated member being pivotally connected to the front portion of said chassis; and an axle extending through said slot, said axle having wheels disposed on opposite end of said axle, said axle being slidably movable within said slot;

first and second spaced-apart swing arms having first and second ends, said first end being connected to said rear portion of said chassis, each of said second ends having a rear wheel rotatably mounted thereto, each of said swing arms being independently movable with respect to said chassis between first and second positions, whereby said rear wheels move closer to said front portion when said swing arms are moved from said first position to said second position;

first and second propulsion drives operatively associated with said chassis and drivingly coupled to respective rear wheels, each propulsion drive adapted to independently drive a respective rear wheel in either a first direction or a second opposite direction; and a remote control receiver adapted to receive remotely generated control signals, said receiver operatively connected to each of said propulsion drives whereby said receiver may independently control each of said propulsion drives.

* * * * *